United States Patent [19]

Nassof

[11] Patent Number: 4,537,116

[45] Date of Patent: Aug. 27, 1985

[54] AIR DRAPE

[75] Inventor: Martin Nassof, 300 Winston Dr., Cliffside Park, N.J. 07010

[73] Assignee: Martin Nassof, Cliffside Park, N.J.

[21] Appl. No.: 614,317

[22] Filed: May 25, 1984

[51] Int. Cl.[3] ..... F24F 9/00

[52] U.S. Cl. ..... 98/36; 98/40.14

[58] Field of Search ..... 98/36, 40 D, 40 N, 87, 98/90; 62/248

[56] References Cited

U.S. PATENT DOCUMENTS

| | | | |
|---|---|---|---|
| 317,265 | 5/1885 | Wood | 98/90 |
| 3,390,624 | 7/1968 | Averill | 98/40 D |
| 4,123,967 | 11/1978 | Shanis | 98/36 |
| 4,475,446 | 10/1984 | McCall | 98/40 D |

FOREIGN PATENT DOCUMENTS

| | | | |
|---|---|---|---|
| 560821 | 6/1931 | Fed. Rep. of Germany | 98/40 N |
| 21984 | of 1912 | United Kingdom | 98/90 |

*Primary Examiner*—Harold Joyce

*Attorney, Agent, or Firm*—Jacobs & Jacobs

[57] ABSTRACT

Apparatus for producing an air curtain at the perimeter of a room, which comprises a plurality of air curtain units for delivering a thin, fan-shaped flow of air mounted adjacent the interior of the wall defining the room and spaced apart by a distance such that the fan-shaped flow of air delivered by each said air curtain unit overlaps the fan-shaped flow of air delivered by the next adjacent air curtain unit; each said air flow unit having an air inlet, a narrow, elongated air outlet, said air outlet being longer and narrower than said air inlet, and a wall between said air inlet and air outlet defining a flow path for air flowing from said air inlet to said air outlet, said wall having a plurality of cross-sections along said flow path to provide a transition between said air inlet and air outlet.

16 Claims, 5 Drawing Figures

FIG. 1
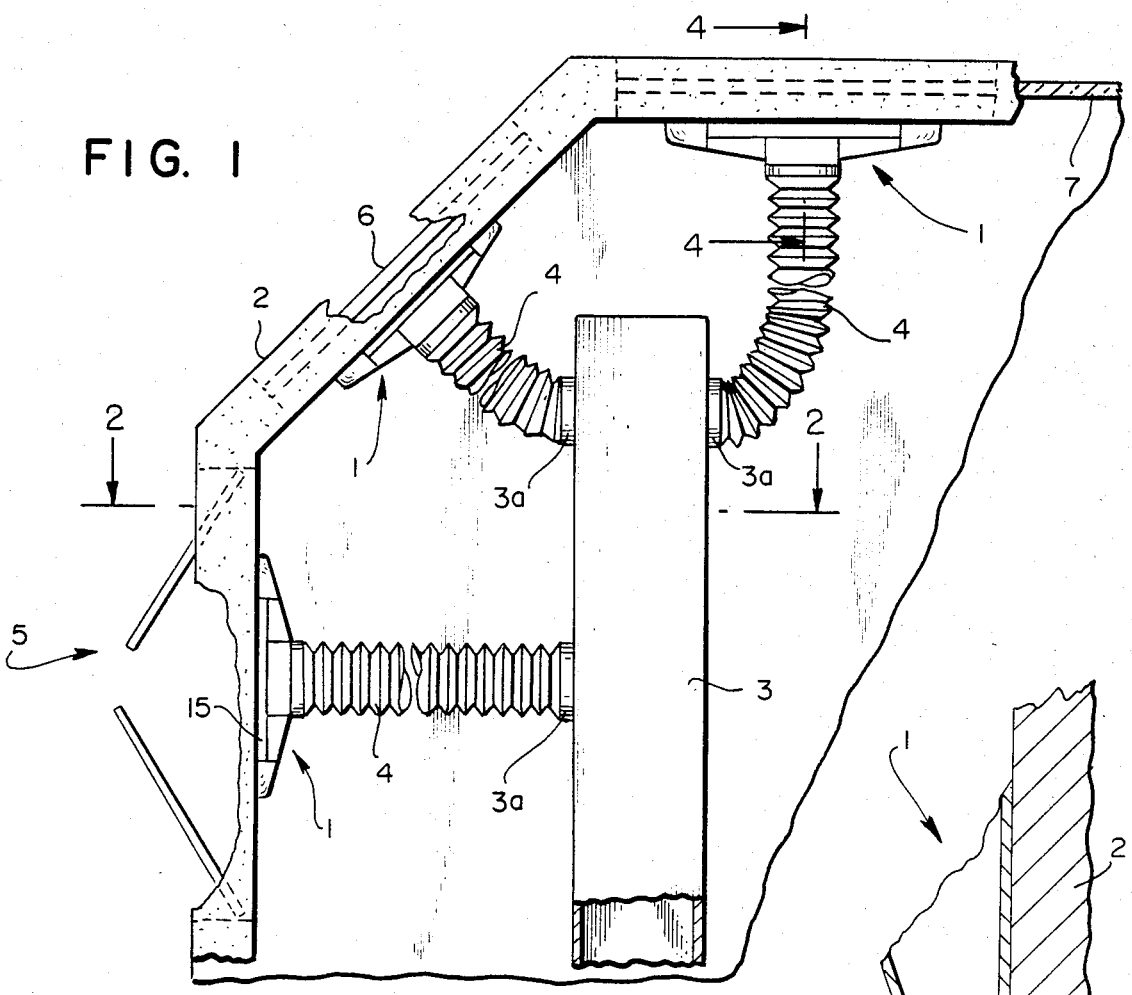
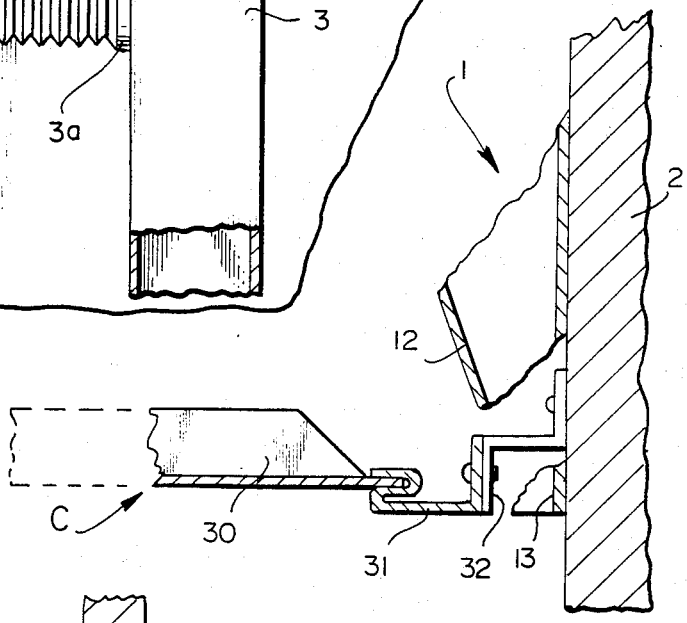
FIG. 5
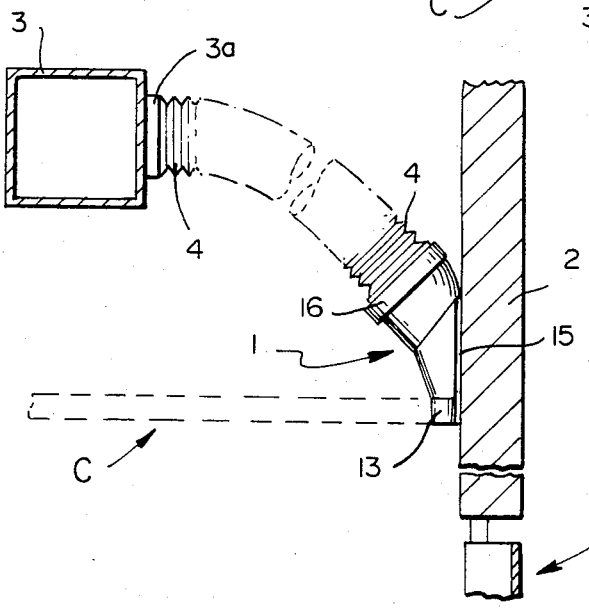
FIG. 2

AIR DRAPE

The present invention relates to a system for creating a curtain of temperature-controlled air around the interior of a room at the exterior wall thereof.

It has previously been known to provide a curtain of warm or cold air adjacent the inside of the exterior wall of a building. For example, in the summer, it has been known to cause cold air to flow downwardly from a distribution duct located in the ceiling at the perimeter of the room adjacent the exterior wall. In winter, warm air is caused to flow from this ceiling duct work. This curtain of temperature-controlled air is useful, for example, adjacent large windows and doors where considerable heat transfer between the room and the exterior environment takes place.

While the use of existing air curtain systems is reasonably suited for use in rooms having straight walls, the existing systems are less effective where the room has uneven, irregular or curved surfaces. In such circumstances, it becomes quite expensive to provide ceiling duct work of such complex shape required to accommodate these structures.

The existing air curtain systems also require a great deal of time, labor and materials to provide a custom design for each of the rooms involved, even where the walls are straight.

The present invention provides an air curtain system that overcomes these problems and has significant advantages in terms of efficiency and economy of installation. According to the present invention a plurality of means for creating a thin curtain of temperature-controlled air are provided at spaced intervals around the interior perimeter of a room. The air curtain means are so designed that when used at the proper spacing, the air curtain created by each of the individual units will overlap the air curtain created by the next adjacent unit so as to provide a continuous air curtain around the entire extent of the room. Through the use of individual air supply means to create small sub-units of the total air curtain, it is also possible to have areas of the room at one temperature and other areas of the room at different temperatures.

The use of individual means for creating small sub-units of the larger air curtain enables the present invention to achieve economies resulting from standardization of the air supply means, thereby obviating the need for a custom design for each room to be modified. Further, the particular design of the means for creating each sub-unit of the air curtain enables each of the units to be hung from the wall or, if desired, suspended from the ceiling. Another feature of the present invention is that the unit can be inconspicuously mounted above the ceiling and behind the ceiling edge mold, thereby eliminating the unsightly clutter of air diffusers and register openings employed in prior art systems.

In accordance with the present invention, there is provided apparatus for delivering a thin, fan-shaped curtain of temperature-controlled air, comprising an air unit having an elliptical air inlet and an elongated, narrow air outlet, the major diameter of the elliptical air inlet being smaller than and parallel to the longitudinal axis of said air outlet, said unit having wall means operable to enable air flowing from said air inlet to said air outlet to undergo a transition whereby the cross-section of said flowing air is changed from an ellipse where it enters said air inlet to a narrow elongated shape where it leaves said air outlet.

The present invention also provides apparatus for creating an air curtain around the perimeter of the room and adjacent to the inside of the wall defining said room, which comprises a plurality of the air units according to the invention spaced apart by a distance such that the flow of air from each air unit overlaps the flow of air from the next adjacent air unit, whereby a continuous air curtain is provided at the perimeter of the room.

The present invention is illustrated in terms of a preferred embodiment in the accompanying drawings, in which:

FIG. 1 is a diagrammatic plan view of a room having the air curtain system of the invention, with the ceiling removed for ease of illustration;

FIG. 2 is a side elevational view, in section, taken along lines 2—2 of FIG. 1, showing a portion of the ceiling;

FIG. 5 is a view, similar to FIG. 4, showing details of the ceiling structure.

Figure 3:
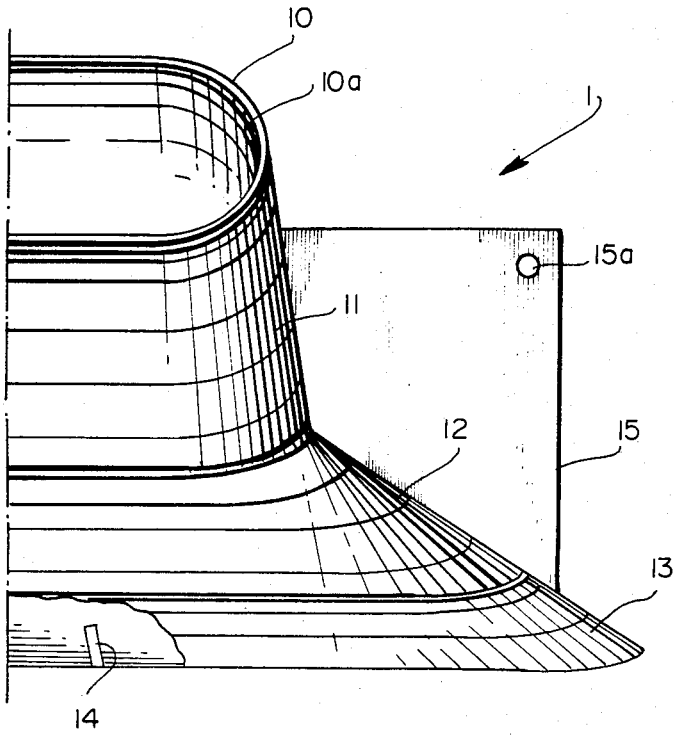
FIG. 3 is a front elevational view of the air flow unit employed in the present invention, with a part broken away for illustration.

Referring to FIG. 1, a plurality of air units 1 are located on the inside of wall 2 around the perimeter of a room. For illustration, wall 2 is of polygonal shape, but it is to be understand that the present invention is applicable to walls having curved surfaces or even to walls having a straight line configuration, or any combination thereof. As shown in FIG. 1, the units 1 are mounted on the interior of the wall as will be discussed later. Each of the units 1 communicates with a main air duct 3 by means of flexible duct 4. One unit 1 is located adjacent glass doors 5, another adjacent a small window 6 and the third adjacent a glass wall 7. If glass wall 7 is quite large, then more than one of the units 1 will be provided.

As shown in FIG. 2, the units 1 are located above ceiling C and are mounted to the wall 2 by means of the mounting bracket 15. As best seen in FIG. 5, the ceiling C is comprised of a plurality of conventional open ceiling panels 30. Adjacent the wall 2, the ceiling panels 30 are held by a slip mold 31, which is connected to spaced apart brackets 32, which are, in turn, connected to the wall 2. Slip mold 31 extends around the perimeter of the room and brackets 32 are fastened to the wall 2 between adjacent air curtain units 1. Accordingly, the several units 1 that will be used in the room will be concealed at the periphery of ceiling C and will be quite unobtrusive.

Figure 4:
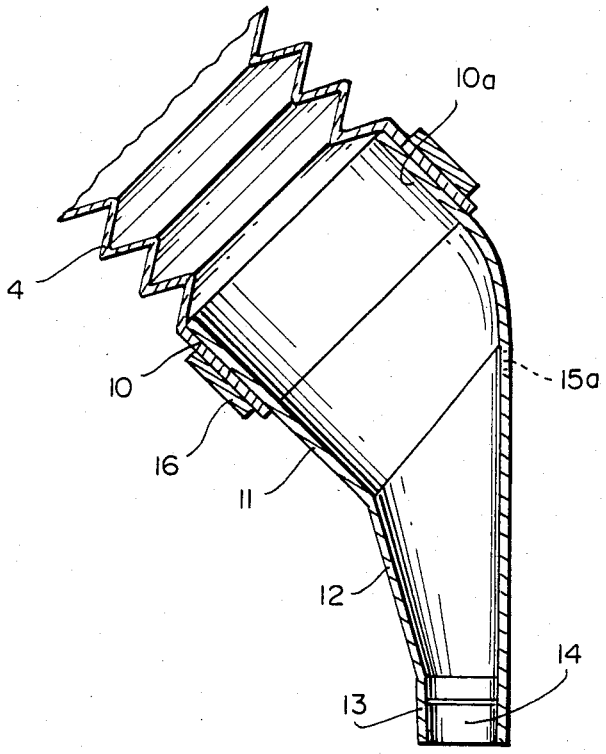
FIG. 4 is an enlarged, detail view, taken in section, along line 4—4 of FIG. 1.

FIGS. 3 and 4 illustrate in detail the construction of the air unit 1. As shown in FIGS. 3 and 4, the unit 1 has an upper end 10 having an air inlet opening 10*a* of elliptical cross-section. Communicating with the upper end 10 is a transition section 11 that communicates with a depending skirt 12 having diverging walls in the direction of air flow. The skirt 12 terminates in an air outlet 13 of rectangular cross-section, the major diameter of the elliptical opening 10*a* being parallel to and considerably less than the longitudinal axis of the air opening 13.

The flexible duct 4 may be any suitable flexible duct work conventionally employed in heating and airconditioning systems. Duct 4 will thus be a circular duct that is attached to the main air duct 3 (FIG. 1) by means of circular flanges 3a. Duct 4 is secured to the air duct 1 by squeezing the free-end of the duct to form an ellipse and fitting the now elliptical end of duct 4 over the upper end 10 (FIG. 4) of the air unit 1, and securing the duct 4 to the upper end 10 by means of collar 16.

The air unit 1 is provided with a plurality of movable vanes 14 (FIGS. 3, 4) to permit adjustments to be made in the flow of air emanating from the air outlet 13. It is additionally noted that the air unit 1 includes a mounting bracket 15 having suitable apertures 15a to enable the air duct 1 to be secured to the wall 2.

It is preferred that the air unit 1 is mounted to the wall 2 in a manner illustrated in the drawings. This will eliminate the need for suspension hardware and thus save the cost of such hardware as well as the cost of the labor to install the air units to the hardware. However, if practical in a given installation, the air unit 1 can be suspended from the ceiling runner bars and suspension members (not shown) conventionally used to suspend the metal panels 30 that form ceiling C.

The optimum size and shape of the air unit 1 and the elliptical opening 10a will, of course, be empirically determined depending upon the amount of air flow to be controlled. Likewise, the spacing between adjacent units to assure the overlapping air curtain effect will also be empirically determined. It has been found that excellent results are obtained using 6" diameter flexible duct work as the ducts 4, whereby the elliptical opening 10a will suitably have a major diameter of approximately $7\frac{3}{8}$" and a minor diameter of approximately $3\frac{3}{8}$". Slight deviations in shape between the elliptical opening 10a and the ellipse formed when the circular end of the duct 4 is squeezed together to form an ellipse are taken up by the use of the collar 16. With an elliptical opening 10a as thus defined, the air outlet opening at the air outlet end 13 may suitably be 18" long and approximately $\frac{5}{8}$" wide. The air unit thus defined may suitably have an overall height of about 8" and when formed of an aluminum casting, the resulting structure is lightweight and hence readily adaptable to be secured to the wall 2 by means of the bracket 15 or, if desired, suspended from the suspension members (not shown).

Using air units 1 of the dimensions described above, it has been found that the air units 1 can be spaced apart approximately 5'6" or more, center-to-center, thereby providing a continuous air curtain around the perimeter of the room as a result of the overlapping of the air curtains formed by the individual units 1. When a 5'6" spacing is employed, the brackets 32 will be four feet long.

Air units 1 are preferably cast aluminum, but they can also be made of other fire resistant material, such as from sheet metal or from fire resistant plastic.

It will be seen that the shape of the air unit 1 causes the air to accelerate as it flows through the air unit 1 from the air opening 10a to the air outlet end 13, despite the fact that the depending skirt 12 has diverging walls, which would ordinarily cause the air flow to decelerate. This is because the cross-sectional area through the air unit 1 perpendicular to the direction of air flow is decreasing as the air flows from the inlet 10 to the outlet 13, and hence air exiting the air unit 1 leaves as a thin, fan-shaped stream of rapidly flowing air, thus enabling the air curtain thus produced to travel from the ceiling of the room to the floor.

Generally, the transition between the elliptical opening 10a and the narrow, longitudinal opening 13 will be a smooth transition, but more abrupt transitions can be employed so long as the thin air curtain is produced. Similarly, while FIG. 4 shows the opening 10a to be inclined with respect to the opening 13, it is possible to have these openings parallel to one another or at any desired angle, depending on the most convenient way to link up the opening 10a with the duct 3.

It is contemplated that the present invention will be carried out with an air flow unit 1 having an air outlet 13 of about one inch wide, or less, thereby creating a thin air curtain that is ideally suited for sweeping downwardly across a large window or window wall to keep the window or window wall free of condensation on the interior thereof. Such condensation is a particular problem in restaurants where interior, moisture-laden air condenses on the inside of the window or window wall during the winter. Warm air passing through the air flow units adjacent the window or window wall will create an air curtain that will "defrost" the window.

The creation of the air curtain of warm or cool air adjacent a solid wall will have the beneficial effect of creating a source of radiant heat or a heat sink, respectively. When warmed air is used to form the air curtain during the cooler months, the wall thus heated will radiate heat into the cooler, interior air. When cooled air is used to form the air curtain during the warmer months, the wall thus cooled will act as a heat sink to absorb some of the heat transferred from the hot, outside air that would otherwise heat the interior air.

It is also an important feature of the invention that the ceiling, when viewed from below, presents an attractive, finished appearance. Thus, the ceiling pans 30 will come up to the air flow units 1, leaving no spaces between them, and the brackets 32 will abut against adjacent units 1, likewise leaving no unsightly spaces. When using units 1 that are only one inch or less wide at air outlet 13, the air curtain system will be virtually concealed, thereby providing an esthetically appealing, finished ceiling.

I claim:

1. Apparatus for producing an air curtain at the perimeter of a room defined by a vertical wall, which comprises a plurality of air curtain means for delivering a thin, downwardly flowing, fan-shaped flow of air mounted adjacent the interior and at the top of the vertical wall defining the room and spaced apart by a distance such that the downwardly flowing, fan-shaped flow of air delivered by each said air curtain means overlaps the fan-shaped flow of air delivered by the next adjacent air curtain means; each said air curtain means having an elongated air inlet, a narrow, enlongated air outlet, said air outlet being longer and narrower than said air inlet, and wall means between said air inlet and air outlet defining a flow path for air flowing from said air inlet to said air outlet, said wall means having opposed wall portions connected between the ends of said air inlet and air outlet and diverging from said air inlet to said air outlet, said wall means further having a plurality of cross-sections along said flow path to provide a transition between said air inlet and air outlet, whereby said air curtain means is operable to provide said thin, fan-shaped flow.

2. Apparatus according to claim 1, wherein said air inlet has an elliptical cross-section, the major diameter of which is smaller than the longitudinal axis of said air outlet.

3. Apparatus according to claim 2, wherein said major diameter is parallel to said longitudinal axis.

4. Apparatus according to claim 2, wherein said air outlet has a rectangular cross-section.

5. Apparatus according to claim 1, wherein said wall of said room comprises at least one portion of polygonal shape.

6. Apparatus according to claim 1, wherein said wall of said room comprises at least one portion that is an exterior wall portion, and said air curtain means are located around substantially the entire extent of the interior of said exterior wall portion.

7. Apparatus according to claim 6, wherein said exterior wall portion comprises a door that opens to the outdoors.

8. Apparatus according to claim 6, wherein said exterior wall portion comprises a glass window.

9. Apparatus according to claim 6, wherein said exterior wall portion comprises a glass wall.

10. Apparatus according to claim 1, wherein said air curtain means is of cast aluminum.

11. Apparatus according to claim 1, wherein said room includes first duct means for supplying temperature controlled air, and a second duct means is connected between said air inlet of each of said air curtain means and said first duct means for flow of temperature controlled air from said first duct means to said air curtain means.

12. Apparatus according to claim 11, wherein said second duct means is of circular cross-section.

13. Apparatus for producing an air curtain at the perimeter of a room defined by a vertical wall, which comprises a plurality of air curtain means for delivering a thin, downwardly flowing, fan-shaped flow of air mounted adjacent the interior and at the top of the vertical wall defining the room and spaced apart by a distance such that the downwardly flowing fan-shaped flow of air delivered by each said air curtain means overlaps the fan-shaped flow of air delivered by the next adjacent curtain means; each said air curtain means having an air inlet of elliptical cross-section, a narrow, elongated air outlet, the major diameter of said air inlet being smaller than the longitudinal axis of said air outlet, said air outlet being narrower than said air inlet, and wall means between said air inlet and air outlet defining a flow path for air flowing from said air inlet to said air outlet, said wall means having opposed wall portions connected between the ends of said air inlet and air outlet and diverging from said air inlet to said air outlet, said wall means further having a plurality of cross-sections along said flow path to provide a transition between said air inlet and air outlet, whereby said air curtain means is operable to provide said thin fan-shaped flow; and said room includes first duct means for supplying temperature controlled air, and second circular duct means connected between said air inlet of each of said air curtain means and said first duct means for flow of temperature controlled air from said first duct means to said air curtain means.

14. Apparatus according to claim 13, wherein said major diameter is parallel to said longitudinal axis.

15. Apparatus according to claim 13, wherein said air outlet has a rectangular cross-section.

16. Apparatus according to claim 13, wherein said air curtain means is mounted on said vertical wall.

* * * * *